US005582898A

United States Patent [19]

Kiser

[11] Patent Number: 5,582,898

[45] **Date of Patent: *Dec. 10, 1996**

[54] POLYSULFIDE COMPOSITES AND METHOD

[75] Inventor: Weldon C. Kiser, Abilene, Tex.

[73] Assignee: Environmental L.L.C., Abilene, Tex.

[ * ] Notice: The term of this patent shall not extend beyond the expiration date of Pat. No. 5,453,313.

[21] Appl. No.: 561,542

[22] Filed: Nov. 22, 1995

Related U.S. Application Data

[63] Continuation-in-part of Ser. No. 505,703, Jul. 21, 1995, which is a continuation of Ser. No. 187,082, Jan. 26, 1994, Pat. No. 5,453,313, and Ser. No. 474,944, Jun. 7, 1995, Pat. No. 5,525,399, which is a continuation-in-part of Ser. No. 187,082.

[51] Int. Cl.[6] ..... B32B 5/16

[52] U.S. Cl. ..... 428/143; 52/309.1; 52/408; 52/411; 52/746.11; 428/147; 428/327; 428/489; 428/920

[58] Field of Search ..... 428/141, 143, 428/147, 327, 489, 492, 334, 920; 156/334, 157; 524/609, 775, 881; 52/315, 408, 411, 309.1, 311.1, 554, 555, 746, 747, DIG. 7, DIG. 9

[56] References Cited

U.S. PATENT DOCUMENTS

| | | | |
|---|---|---|---|
| 3,314,205 | 4/1967 | Davis, Jr. | 52/309.1 |
| 3,547,674 | 12/1970 | Draper et al. | 428/284 |
| 3,844,668 | 10/1974 | Winters et al. | 404/72 |
| 3,919,148 | 11/1975 | Winters et al. | 524/62 |
| 4,032,491 | 6/1977 | Schoenke | 524/68 |
| 4,196,115 | 4/1980 | Bresson | 524/68 |
| 4,640,730 | 2/1987 | Streets et al. | 156/334 |
| 4,897,137 | 1/1990 | Miller et al. | 156/157 |
| 4,897,443 | 1/1990 | Robinson et al. | 524/609 |
| 5,258,222 | 11/1993 | Crivelli | 428/323 |
| 5,453,313 | 9/1995 | Kiser | 428/143 |

FOREIGN PATENT DOCUMENTS 342873 6/1972 U.S.S.R. .

OTHER PUBLICATIONS

Bauman, Compalloy '93, Proc. Int. Congr. Compat. React. Polym. Alloying, 8th (1993), 343–54. Products Made with Surface–Modified Particles (Apr. 28, 1993).

Izv. Vuzov, Stroit. Arkhit, 1986 (5), 52–4, Ovsyannikova, N.N. Bitumen–Polymer Coverings for Athletic Surfaces.

*Primary Examiner*—Hoa T. Le
*Attorney, Agent, or Firm*—John L. Sigalos

[57] ABSTRACT

A fire retardant mat is disclosed comprising rubber particles bonded together with a binder containing an elastomeric polysulfide and a polyolefin, with the mat also containing a fire retardant. A composite is also disclosed in which the mat is coated with a fire retardant coating in which an elastomeric polysulfide is part of the coating. Further, there is disclosed a method of making the mat by extrusion and also of placing a fire retardant coating on the mat after extrusion.

13 Claims, No Drawings

POLYSULFIDE COMPOSITES AND METHOD

CROSS REFERENCE TO RELATED APPLICATIONS

The instant application is a Continuation-in-Part of U.S. application Ser. No. 08/505,703, filed Jul. 21, 1995 which, in turn, is a Continuation of U.S. application Ser. No. 08/187,082, filed Jan. 26, 1994, now U.S. Pat. No. 5,453,313, and of U.S. application Ser. No. 08/474,944 filed Jun. 7, 1995, now U.S. Pat. No. 5,525,399 which, in turn, is a Continuation-in-Part of U.S. application Ser. No. 08/187,082, filed Jan. 26, 1994, now U.S. Pat. No. 5,453,313.

BACKGROUND OF THE INVENTION

The present invention relates to novel rubber particle mats, to the method of making the same, and to composites utilizing such mats to make a variety of products, including roofing, surfaces of sports tracks or playing fields, sound dampening surfaces, containment barriers, and the like.

The parent applications whose entire specifications, drawings, and claims are specifically incorporated herein by reference disclose novel composites and methods of forming the same.

More specifically, therein the rubber mats utilized are made by adhering together rubber particles such as crumb rubber particles, preferably utilizing a elastomeric polysulfide as a binder to form the mat.

Most commonly, such rubber mats have been made by molding, which is a cost-prohibitive procedure. The mats are formed by molding a mixture of rubber particles and a binder into a shape, usually square or rectangular. When rolls of the mat are desired, a molded log is formed of various length of the rubber particles bonded together. At such time as a roll of the mat is desired, the log is then "peeled" to the proper thickness of mat desired. In this manner from a single log, a mat of any desired thickness can be prepared. Such "peeling" is similar to that used to peel wood logs in forming veneers.

As noted, such molding is costly and time consuming. In addition, such rubber mats are not entire satisfactory for many uses, such as roofing where it is desired to have a fire rating, preferably a Class A fireproof rating, and in other areas where like fireproof properties are desired, such as in preparing flooring, soundproofing, and in containment structures around oil storage facilities.

SUMMARY OF THE INVENTION

It has now been found that novel rubber mats can be prepared utilizing extrusion procedures which greatly decreases the cost thereof, which mats are suitable for use in assemblies where fireproof ratings are desired.

Briefly, the present invention comprises a fire retardant rubber mat formed of rubber particles, preferably crumb rubber particles, bonded together with a binder comprising a combination of an elastomeric polysulfide and a polyolefin and containing a fire retardant.

The invention also comprises a method of forming such rubber mats by extrusion as set forth in greater detail hereinafter.

In addition, the present invention comprises composites in which rubber mats, in accord with the instant invention, have at least one outer layer of an elastomeric polysulfide alone or in combination with rubber particles and/or a roofing asphalt.

DETAILED DESCRIPTION

The rubber mats of the instant invention utilize rubber particles, preferably those particles made from scrap rubber materials, such as old tires, sidewall carcass buffings, and the like. They can also be rubber crumb made from styrene-butadiene rubber (SBR) or other synthetic rubber. Such rubber particles come in various mesh sizes and while there is no criticality in the mesh sizes utilized in the mats of the instant invention, the size is preferably such as passes through the filters commonly used on most conventional extruders.

In order to bind the particles together in accord with the instant invention, it is necessary to use a combination of an elastomeric polysulfide and a polyolefin. Any conventional curable liquid elastomeric polysulfide can be utilized for this purpose, particularly those sold under the trademark THIOKOL. These are of the general formula HS-$(RX_x)$n-RSH wherein x is 1 to 3, n can vary widely and R is an alkyl, alkylether or alkylthioester group wherein the alkyl group may have up to six carbon atoms. The particularly desired liquid polysulfide polymers are Thiokol LP3, LP33, LP977, P980, LP2 and LP32. They are two component 100% solid compositions which cure by the chemical reaction of the two components. It is preferred to use a version of the THIOKOL RLP composition liquid polysulfide elastomeric containing flame-extinguishing chemicals. Obviously, for roofing, flooring, sound deadening, and containment, this is a desirable feature. As is known, such liquid polysulfide rubbers can contain a curing agent for purposes of curing the same, such as epoxy cured polysulfides. The liquid polysulfide can thus be epoxy cured, a water emulsion, or a combination of both. In addition, hot melt polysulfide rubbers can be used. Such polysulfides are gel types and available from Morton International, one particular one having the designation "ZR2507". The polysulfides have various viscosities, but it is preferred to use one with a Brookfield viscosity of about three poise, but higher viscosities can be utilized.

With respect to the polyolefin utilized, it is preferred to use a polyethylene or a polypropylene and such polyolefin can be either a virgin polyolefin or scrap, namely post-consumer polyolefins obtained by recycling of polyolefins. it is preferred to use the post-consumer polyolefin scrap because of the lower cost.

The rubber mats also contain the well-known materials used to provide fire resistance and self-extinguishing properties and UV absorbers to minimize ultraviolet degradation. Such fire resistance or flame-retarding agents commonly used include inorganic salts such as ammonium sulfanate, zinc borate, and antimony oxychloride; chlorinated organic compounds such as chlorendic anhydride; alumina trihydrate, and certain organic phosphates and phosphonates. It has also been found that roofing aggregate by-product dust is suitable for this purpose.

As to known UV absorbers that can be used, examples are the benzophenones, benzotriazoles, substituted acrylonitriles, and phenol-nickel complexes. These can be included in the binder composition, in the rubber particles, or included in the mixture of binder and rubber particles to be extruded. Rubber particles made from tires will often contain a certain percentage of UV absorbers.

In addition, fillers such as silicates, carbonates, and carbon black, can be utilized as part of the composition if desired to strengthen the mat.

For fire retardancy, compound(s) conventionally used therefor as discussed above can be used in an amount sufficient to give the degree of retardancy desired. This will vary dependent mainly on the particulars of the rubber particles and binder used, but can be readily determined by routine experimentation. In like manner, the usual UV absorbers are utilized in their usual amounts to help prevent degradation. As previously noted, it is preferred to use roofing aggregate by-product dust. Such by-product dust is left over when aggregate is ground to make the conventional roofing aggregate that is placed on roofing and on shingles. It has been found that such roofing aggregate by-product dust gives excellent fire retardancy and greatly reduces the flaming of the mat.

As to proportions, the mat should preferably contain at least 50 wt % most preferably 75 wt % rubber particles, but can contain as little as 30 wt. %. The balance of the mat is binder and fire retardant, hut UV absorbers and fillers can he added as optional additives with the filler assisting in giving impact and abrasion resistance.

As to the binder, as little as 20 wt. % can he utilized, hut it is essential that at least 5 wt. % be an elastomeric polysulfide to ensure flexibility, bonding of the top coat to the mat and improved UV tolerance.

The amount of fire retardant can vary widely, dependent upon the fire rating desired. With the instant invention it is possible to obtain mats with non-rated, Class C, Class B, and Class A ratings, as such ratings are defined in ASTM standards for fire ratings for roofing. In like manner, the amount of UV absorber(s) used can vary widely dependent upon the degree of exposure to which it is anticipated the mat will he exposed. With respect to the fillers, they can he added in any amount that does not adversely affect the flexibility of the mat.

A suitable mat composition comprises 30 to 75 wt. % crumb rubber particles, 20 to 70 wt. % binder with the polysulfide comprising at least 5 wt. % with the balance polyolefin, and fire retardant(s) in an amount sufficient to give the fire rating desired, it being understood that for each wt. % of fire retardant used, there is subtracted one wt. % of hinder so long as the minimum amount of binder and polysulfide is used.

While these novel mats with the combination of the polysulfide and the polyolefin can be formed by molding, extrusion or calendering, it is preferred to extrude the same.

In extruding the rubber mat, any conventional extrusion apparatus can be utilized and there is added thereto the rubber particle crumbs thoroughly admixed with the binder composition and fire retardant(s), and, if utilized, UV absorber(s) and fillers. The extrusion temperature is that which will not degrade the binder or the crumb rubber particles. The time in the extruder is sufficient when taken with the conventional associated air cooling or liquid cooling means to solidify the mat to the thickness desired.

If desired, conventional blowing agents, such as hydrazine and related compounds, can be added to the composition in such circumstances when it is desired to utilize the mats of the present invention as sound deadening devices. Such blowing agents are well known and conventional and the temperature of the extrusion is such that when the extrudate is passed to the confined zone where the gas is generated by the blowing agents, the gas will expand the mat and form the desired air cells.

As previously discussed, the fire retardant mats of the instant invention can be utilized for a variety of uses; namely, as sound deadening surfaces, roofing, flooring, and containment.

With respect to roofing, the mat in accord with the present invention can be used for new roofing or for existing built-up roofing and coated, and granules placed over the coating is as conventional. More particularly, a surface of the mat can be partially or completely coated with an elastomeric polysulfide alone or with crumb rubber added to the polysulfide in order to enhance the hail resistance of the roofing as shown in the parent applications. It is also possible to utilize admixtures of a bituminous material, preferably a roofing asphalt, modified with polysulfide, as is set forth in copending Application Ser. No. 08/474,944, whose disclosure has been incorporated herein by reference. Such coatings must also contain a fire retardant, as discussed above, in an amount sufficient to give the fire rating desired. Thus, the final composite will be fire retardant whether used for roofing, sound deadening, containment, or other use.

As in the parent applications, tile, shakes, panels, and shingles can be formed in the same manner as set forth therein. For example, if a roofing shingle is to be formed, a continuous roll of the mat of the desired thickness is coated with the elastomeric polysulfide as by spraying, roller coating, trowelling, or the like, and the resultant composite cut to the particular shingle shape desired. It will be evident that more than one layer of elastomeric polysulfide can be applied. It will also be evident that the type and thickness of the crumb rubber mat and elastomeric polysulfide coating used can be varied widely depending primarily upon the structural strength and resilience desired in the roofing structure. This is particularly true with respect to flat roofs in which there may be high foot traffic, or the setting of various hi-vac units or mechanical equipment. Thickness of the crumb rubber mat for such usage should be, therefore, much greater than for other surfaces nor subject to the above-noted stresses. Thickness of the mat and elastomeric polysulfide coating are also dependent upon the environment of the particular geographical location; i.e., severity of temperature change, wind velocity, and rainfall amounts and can be determined by routine experimentation.

If used for primary or secondary containment, the mat of this invention is secured in place and there is then applied thereover a coating, preferably a polysulfide coating, with or without crumb rubber particles therein, to the desired thickness. The polysulfide coating can also be modified by admixing therewith a fire retardant(s) and/or UV absorber(s).

In all of the above instances where a coating of polysulfide, with or without rubber particles, or a polysulfide-modified asphalt is used to form a roof, or a roofing product such as a shingle, or a primary or secondary containment, it is also necessary to ensure the presence of fire retardant(s) in the coating to achieve the fire rating desired, preferably an amount sufficient for a Class A rating.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A fire retardant rubber mat consisting essentially of rubber particles bonded together with a binder consisting essentially of at least 5 wt. % of an elastomeric polysulfide and a polyolefin, and a fire retardant in an amount sufficient to make the mat fire retardant.

2. The rubber mat of claim 1, wherein the polyolefin is a recycled polyethylene.

3. The rubber mat of claim 2, wherein the fire retardant is roofing aggregate by-product dust.

4. The rubber mat of claim 3, wherein said mat comprises for each 100 wt. % thereof, 30 to 75 wt. % rubber particles, 20 to 70 wt. % binder, and the balance fire retardant.

5. The rubber mat of claim 4, wherein said mat also contains a UV absorber.

6. The rubber mat of claim 4 containing at least one fire retardant in an amount sufficient to give the mat a Class A fire rating.

7. A fire retardant composite comprising a fire retardant rubber mat comprising rubber particles bonded together with a binder comprising at least 5 wt. % of an elastomeric polysulfide and a polyolefin, and a fire retardant in an amount sufficient to make the mat fire retardant and having on at least a portion of one surface thereof a fire retardant coating, said coating comprising an elastomeric polysulfide or a bituminous material having an elastomeric polysulfide admixed therewith, with or without rubber particles distributed substantially uniformly in said coating, and containing a fire retardant in an amount sufficient to make the coating fire retardant.

8. The composite of claim 7, wherein the polyolefin is a recycled polyethylene.

9. The composite of claim 8, wherein the fire retardant is roofing aggregate by-product dust.

10. The composite of claim 9, wherein said mat comprises for each 100 wt. % thereof, 30 to 75 wt. % rubber particles, 20 to 70 wt. % binder, and the balance fire retardant.

11. The composite of claim 10, wherein said coating also contains a UV absorber.

12. The composite of claim 9, wherein said mat and said coating each contain at least one fire retardant in an amount sufficient to give the composite a Class A fire rating.

13. The composite of claim 12 in the form of a roofing shake, roofing tile, roofing panel, or roofing shingle.

* * * * *